US007955132B2

(12) United States Patent
Luo

(10) Patent No.: US 7,955,132 B2
(45) Date of Patent: Jun. 7, 2011

(54) HDMI CABLE CONNECTOR

(75) Inventor: Fu-Yong Luo, Dongguan (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/691,004

(22) Filed: Jan. 21, 2010

(65) Prior Publication Data

US 2011/0028038 A1 Feb. 3, 2011

(51) Int. Cl.
*H01R 13/648* (2006.01)

(52) U.S. Cl. ..... 439/607.41; 439/607.46; 439/607.51

(58) Field of Classification Search ..... 439/607.41, 439/607.46, 607.51, 607.58
See application file for complete search history.

(56) References Cited

U.S. PATENT DOCUMENTS 7,267,579 B1 * 9/2007 Wu ..... 439/607.57
7,530,847 B2 * 5/2009 Siems ..... 439/607.41
7,815,445 B2 * 10/2010 Wu et al. ..... 439/99
2004/0147166 A1 * 7/2004 Lai ..... 439/610
2007/0141907 A1 * 6/2007 Kuo et al. ..... 439/607
2009/0068891 A1 * 3/2009 Osenberg ..... 439/610
2009/0311910 A1 * 12/2009 Kleinke ..... 439/607.51

* cited by examiner

*Primary Examiner* — Gary F. Paumen
(74) *Attorney, Agent, or Firm* — Timoty M. Morella

(57) ABSTRACT

A cable connector comprising a connector, a cable, a circuit board electrically connecting the connector to the cable, an insulating inner housing and an outer housing. The connector comprises an insulating housing, a plurality of conductive terminals disposed therein and a metal shield mounted on the periphery of the insulating housing. The insulating inner housing comprises upper and lower casings integrally coupled together and a receiving space formed therebetween for accommodating the circuit board. The cable connector comprises a copper foil which covers the periphery of the insulating inner housing. The copper foil is electrically coupled to the metal shield and grounded through the metal shield. Finally, the outer housing envelopes the periphery of the copper foil. Thereby, the cable connector can achieve both miniaturized and a lower cost, while also reducing the rate of defective products.

20 Claims, 6 Drawing Sheets

HDMI CABLE CONNECTOR

REFERENCE TO RELATED MATTERS

The Present Disclosure claims priority of prior-filed Chinese Patent Application No. 200920003339.1, entitled "Cable Connector," and filed 23 Jan. 2009, the contents of which is fully incorporated in its entirety herein.

BACKGROUND OF THE PRESENT DISCLOSURE

The Present Disclosure relates generally to an electrical connecting device, and in particular to a cable connector.

Generally, a conventional cable connector comprises a connector, a cable, a connected circuit board and an outer housing. The cable connector is electrically connected to the cable through the connected circuit board. The periphery of the connection portion for the connector and the cable is enveloped by the outer housing. In order to shield electromagnetic interference, it is typical to adopt a metal inner housing for receiving the connected circuit board, located between the connector and the cable, subsequent to forming a plastic outer housing for insulation and manual plug-pull operation by over-molding at the outside of the metal inner housing. In this conventional structure, since the metal inner housing is electrically conductive, it is necessary to maintain a relative large gap between the metal inner housing and the connected circuit board so as to prevent the occurrence of short circuit. Therefore, the metal inner housing is usually formed with a relative large profile, which negatively affects the miniaturization of the product and results in a higher cost.

In an attempt to solve the above technical problem, various design solutions have been developed. For example, Chinese Patent No. 94205297.8 discloses a computer connector. In this patent, an inner mold is initially formed between a terminal housing and a power line. Then, the periphery of the inner mold is covered by a layer of foil to obtain the electromagnetic shield. Finally, an outer mold is integrally formed therewith, thus insulating the inner mold. Thus, the gap between the inner and outer molds is minimized, and, accordingly, the profile dimension of the cable connector is reduced. However, this design solution is primarily adapted for a cable connector without a connected circuit board. If this solution is applied to a cable connector having a connected circuit board, the electrical properties, or the welding spot of electrical components on the circuit board, could suffer due to the high temperature and high pressure associated in forming the inner mold, resulting in an increase of defective products.

SUMMARY OF THE PRESENT DISCLOSURE

For overcoming the aforementioned deficiencies, an object of the Present Disclosure is to provide a low-cost miniaturized cable connector having a decreased rate of defective products.

In order to achieve this object, a cable connector in the Present Disclosure comprises a connector, a cable, a circuit board electrically connecting the connector to the cable, an insulating inner housing and an outer housing. The connector comprises an insulating housing, a plurality of conductive terminals disposed therein and a metal shield mounted on the periphery of the insulating housing. The insulating inner housing comprises upper and lower casings integrally coupled together and a receiving space formed therebetween for accommodating the circuit board. The cable connector comprises a copper foil which covers the periphery of the insulating inner housing. The copper foil is electrically coupled to the metal shield and grounded through the metal shield. Finally, the outer housing envelopes the periphery of the copper foil.

The cable connector further comprises a sleeve closely embedded at the periphery of the cable. The sleeve is exposed from the insulating inner housing and is covered and fixed by the outer housing so as to perform a function of strain relief. Further, at least one first positioning member protrudes toward the lower casing from an inner surface of the upper casing, a second positioning member protrudes toward the upper casing from an inner surface of the lower casing, and the circuit board is clamped between the positioning members.

In comparison with the description above, a technical advantage effect of the Present Disclosure is that the connected circuit board, located between the connector and the cable, is accommodated in an insulating inner housing formed by combining the upper and the lower casings. Further, the copper foil covers the periphery of the insulating inner housing to shield electromagnetic interference. Finally, the plastic outer housing is integrally formed. Since the insulating inner housing is non-conductive, the gap between the insulating inner housing and the circuit board may be small enough so as to miniaturize the cable connector. Moreover, the sleeve, designed to be embedded at the periphery of the cable and covered by the outer housing, can function as strain relief, preventing the electrical contact between the cable and the circuit board from being damaged when the cable is stretched under an external force.

In addition, the upper casing is in combination with the lower casing, forming the insulating inner housing for receiving the connected circuit board. As such, it can protect the electrical properties and the welding spot of the electrical components on the circuit board from disparate impact due to both high temperature and high pressure when forming the inner mold, and thusly avoid the increase of the defectivity rate.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

In the illustrated embodiments, directional representations—i.e., up, down, left, right, front, rear and the like, used for explaining the structure and movement of the various elements of the Present Disclosure, are relative. These representations are appropriate when the elements are in the position shown in the Figures. If the description of the position of the elements changes, however, it is assumed that these representations are to be changed accordingly.

Figure 1:
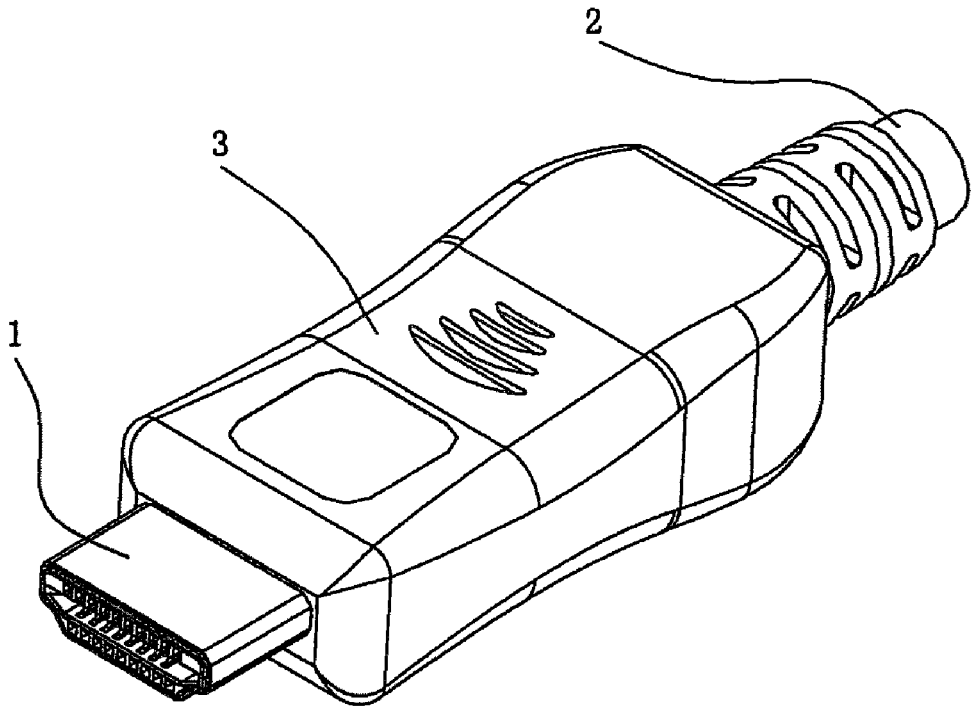
FIG. 1 is an assembled perspective view of the cable connector according to an embodiment of the Present Disclosure.
Figure 2:
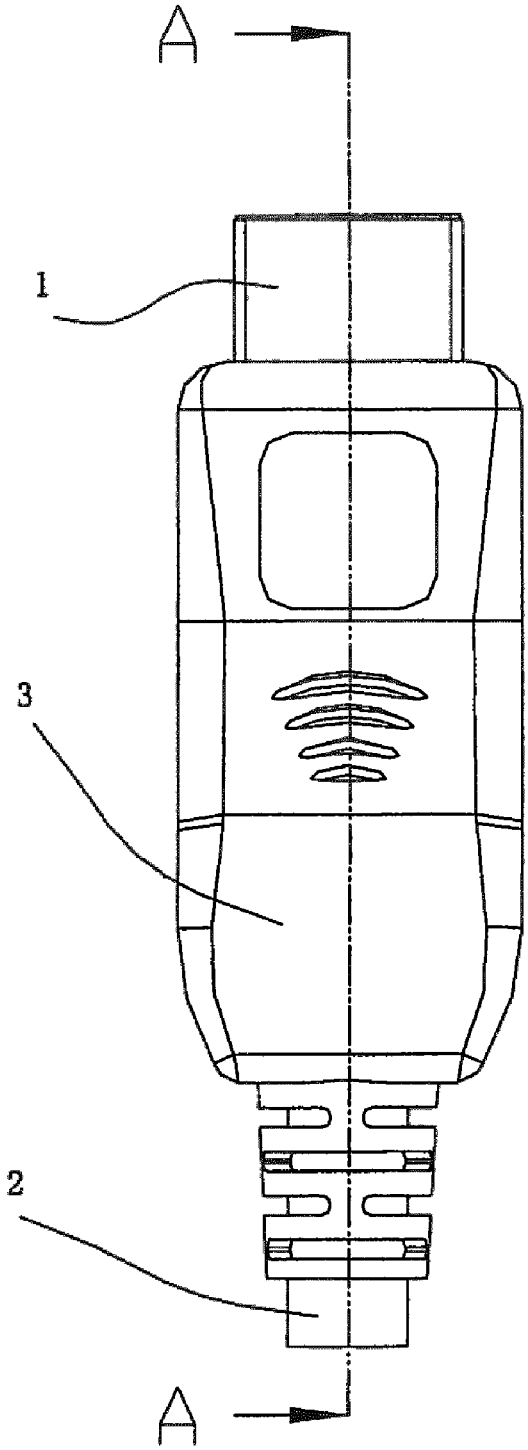
FIG. 2 is a front view of the cable connector of FIG. 1.
Figure 3:
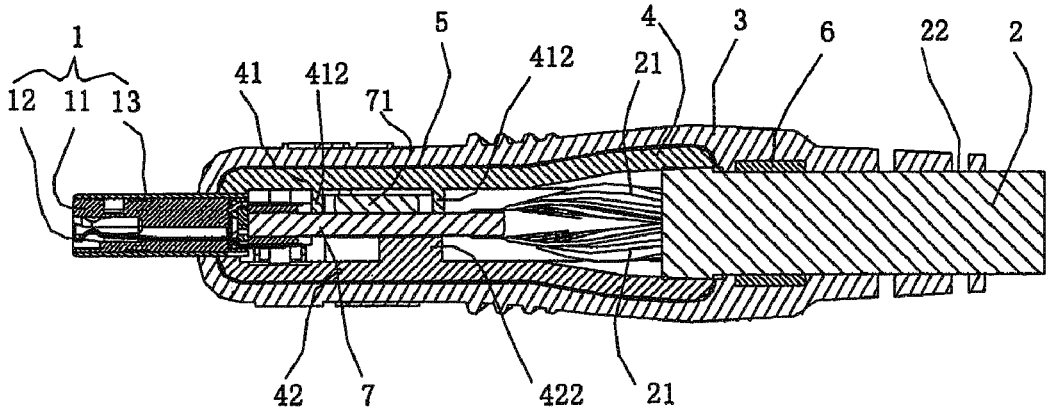
FIG. 3 is an enlarged cross-sectional view along the line A-A in FIG. 2.
Figure 4:
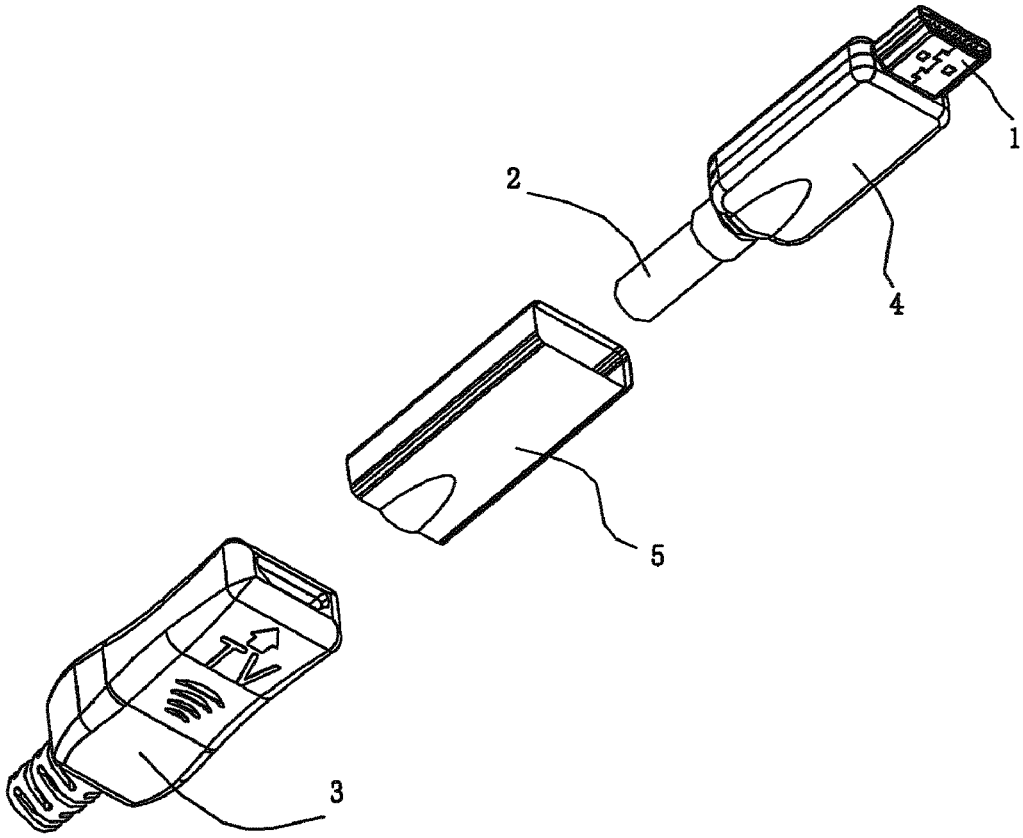
FIG. 4 is an exploded perspective view of the cable connector of FIG. 1, in which an upper casing is assembled with a lower casing together.
Figure 5:
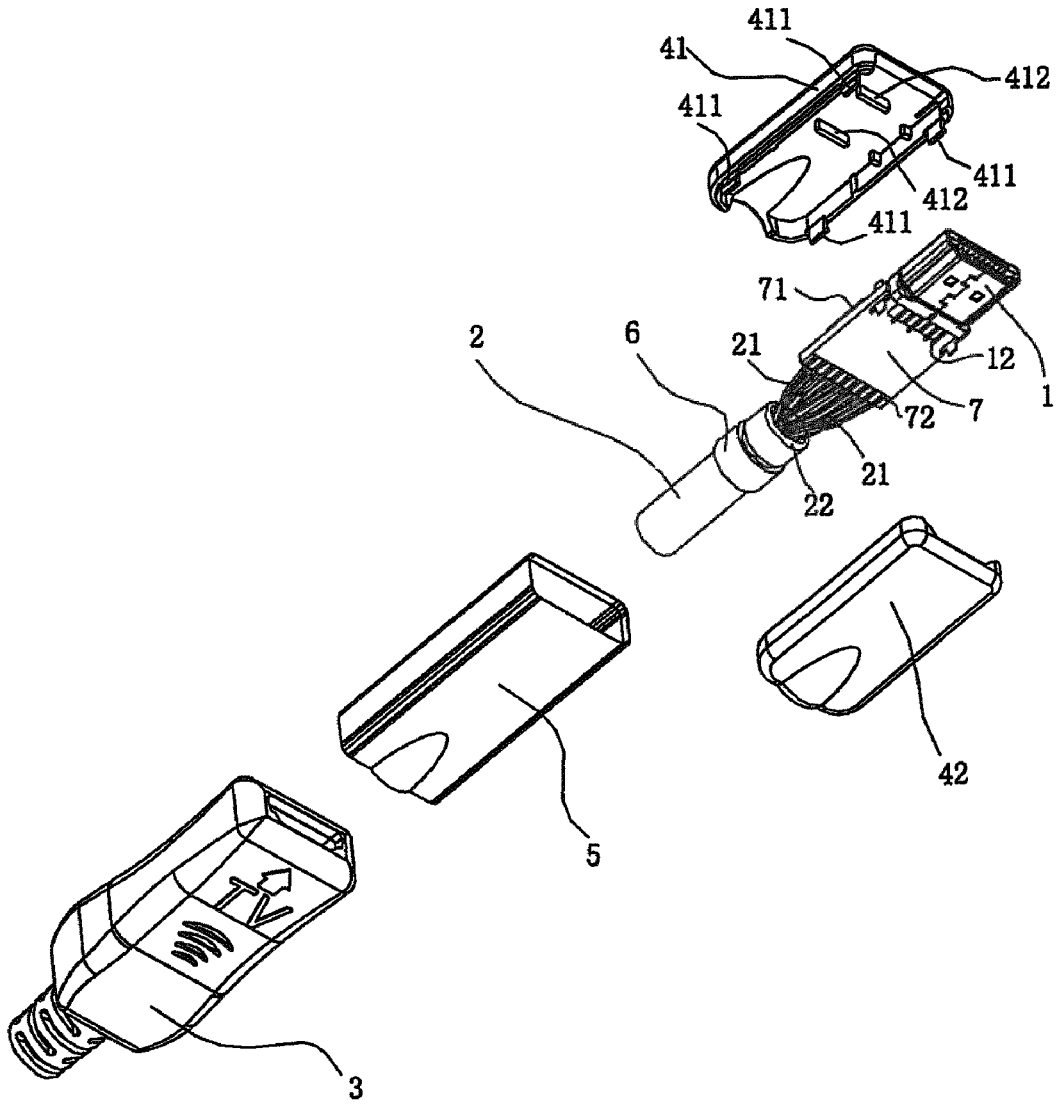
FIG. 5 is another exploded perspective view of the cable connector of FIG. 1, in which the upper casing is separated from the lower casing.
Figure 6:
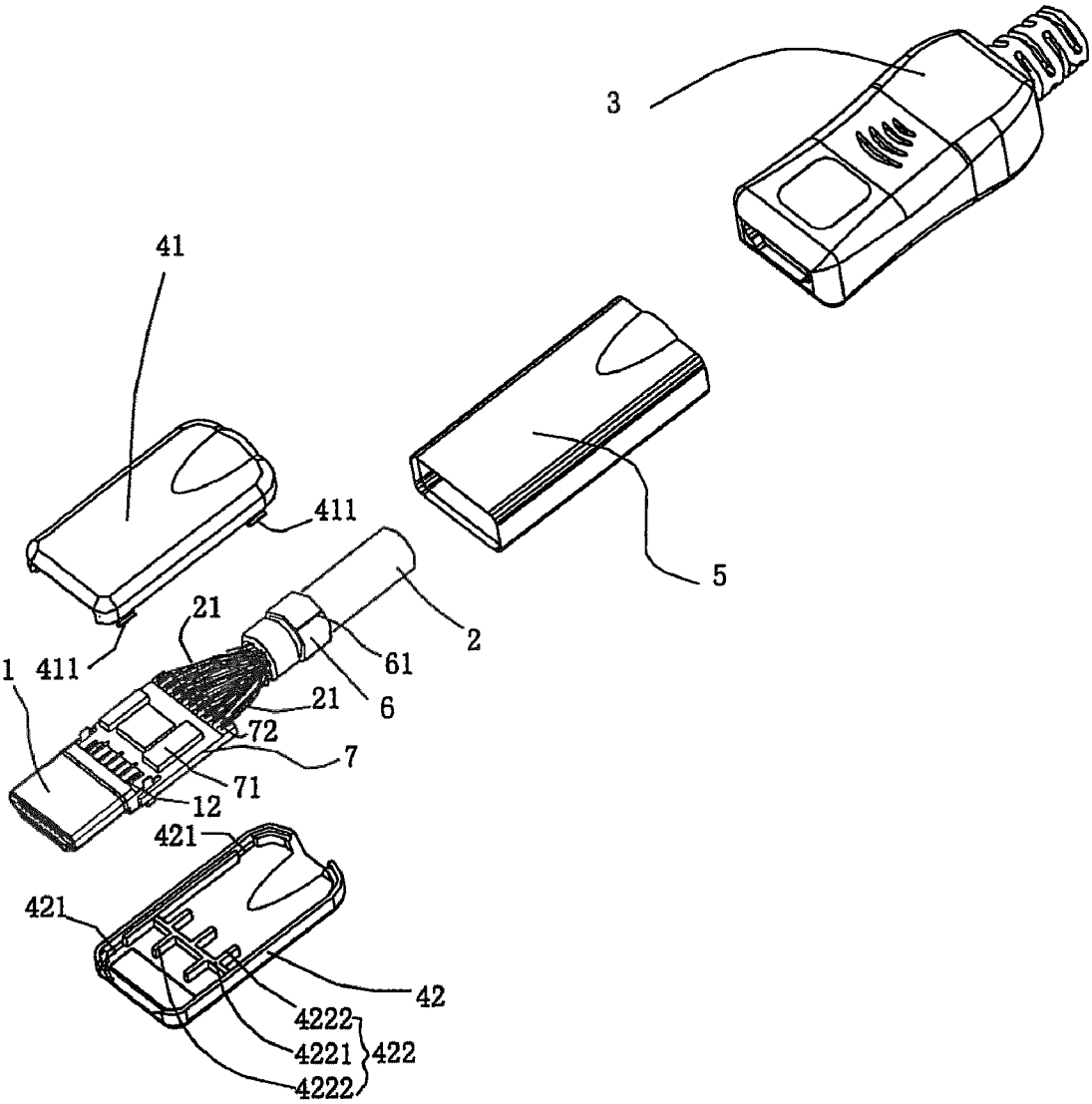
FIG. 6 is another exploded perspective view of the cable connector of FIG. 1, in which the upper casing is separated from the lower casing.

As illustrated in FIGS. 1-6, the cable connector comprises connector 1, cable 2, outer housing 3, insulating inner housing 4, copper foil 5, sleeve 6, and circuit board 7. Referring to FIGS. 3 and 5-6, connector 1, which is a HDMI connector, comprises insulating housing 11, plurality of conductive terminals 12 disposed on insulating housing 11, and metal shield 13 covering the periphery of insulating housing 11. Cable 2 comprises jacket 22 and plurality of core wires 21 contained in the inner side of jacket 22. Plurality of electrical components 71 are mounted at the middle of circuit board 7. Plurality of pads 72 are disposed at both ends of circuit board 7 respectively. Conductive terminals 12 of connector 1 are correspondingly soldered together with pads 72 at one end of circuit board 7 while core wires 21 of cable 2 are correspondingly soldered together with pads 72 at the other end of circuit board 7.

Referring to FIGS. 5-6, insulating inner housing 4 comprises upper casing 41 and lower casing 42, made of insulating materials and integrally coupled together. Four locking hooks 411 extend downwardly from two side edges of upper casing 41, and two first positioning members 412 protrude toward lower casing 42 from inner surface at the middle of upper casing 41 and extend transversely with fore-and-aft interval between each other. Four locking parts 421 are provided at two side edges of lower casing 42 for being connected with locking hooks 411 in locking manner, so that a receiving space is formed between upper and lower casings 41, 42. Second positioning member 422 protrudes toward upper casing 41 from the inner surface at the middle of lower casing 42 to upper casing 41. Second positioning member 422 comprises main body 4221 extending transversely and plurality of locating ribs 4222 extending backwards and forwards respectively from main body 4221. Two locating ribs 4222 extending forward and three locating ribs 4222 extending backward. Circuit board 7 is accommodated in the receiving space of insulating inner housing 4, and clamped between first and second positioning members 412, 422. First and second positioning members 412, 422 function as planes which snap and fix circuit board 7 in fore-and-aft and transverse directions, so that circuit board 7 can be held stably, and blockage of electrical components 71 can be avoided.

Copper foil 5 envelopes the periphery of insulating inner housing 4 integrally and is electrically connected with metal shield 13 of connector 1. Electromagnetic interference (EMI) can be shielded through grounded metal shield 13. Further, sleeve 6 is exposed at the rear of insulating inner housing 4, which is a metal ring having notch 61, and is closely embedded at the periphery of jacket 22 of cable 2.

Outer housing 3 is formed at the periphery of copper foil 5 in an over molding process, at the same time sleeve 6 is covered and fixed in outer housing 3. When cable 2 is stretched under external force, sleeve 6, which covers the periphery of cable 2, functions as strain relief, and thereby most tension is transferred to outer housing 3, which may prevent the soldering portion between core wires 21 of cable 2 and circuit board 7 from being damaged.

The manufacturing process for the cable connector of the Present Disclosure generally comprises the following steps. First, conductive terminals 12 on connector 1 are soldered to pads 72 at one end of circuit board 7 correspondingly. Next, core wires 21 of cable 2 are soldered to pads 72 at the other end of circuit board 7 correspondingly. Upper casing 41 is assembled with lower casing 42 to form insulating inner housing 4 having a hollow receiving space, in which circuit board 7 is accommodated therein and firmly positioned by first and second positioning members 412, 422. The periphery of insulating inner housing 4 is covered by copper foil 5, and engages the front edge of copper foil 5 with metal shield 13 for achieving electrical connection. Sleeve 6 is embedded at the periphery of jacket 22. Finally, outer housing 3 at the periphery of copper foil 5 and sleeve 6 are formed by overmolding process.

While a preferred embodiment of the Present Disclosure is shown and described, it is envisioned that those skilled in the art may devise various modifications without departing from the spirit and scope of the foregoing Description and the appended Claims.

What is claimed is:

1. A cable connector comprising:

a connector, a cable, a circuit board which electrically connects the connecter to the cable, an insulating inner housing and an outer housing; wherein the connector comprises an insulating housing, a plurality of conductive terminals disposed in the insulating housing and a metal shield being mounted on the periphery of the insulating housing;

being characterized in that the insulating inner housing comprises an upper casing and a lower casing which are integrally coupled with each other, a receiving space is formed between the upper casing and the lower casing for accommodating the circuit board;

the cable connector further comprises a copper foil which envelopes the periphery of the insulating inner housing; the copper foil is in electrical connection with the metal shield and grounded through the metal shield; the outer housing envelopes the periphery of the copper foil.

2. The cable connector according to claim 1, further comprising a sleeve which is close embedded at the periphery of the cable, the sleeve is exposed at the rear of the insulating inner housing and is covered and fixed by the outer housing.

3. The cable connector according to claim 2, wherein the sleeve is a metal ring having a notch.

4. The cable connector according to claim 3, wherein at least one electrical component are mounted at the middle of the circuit board, a plurality of pads are disposed at both end of the circuit board respectively, the conductive terminals of the connector are soldered with the pads at one end of the circuit board correspondingly.

5. The cable connector according to claim 3, wherein the cable comprises a jacket and a plurality of core wires contained in the jacket, the core wires are soldered with the pads at the other end of the circuit board correspondingly.

6. The cable connector according to claim 1, wherein at least one first positioning member is protruded toward the lower casing from an inner surface of the upper casing, a second positioning member is protruded toward the upper casing from an inner surface of the lower casing, and the circuit board is clamped between the second positioning member and the at least one first positioning member.

7. The cable connector according to claim 6, wherein the at least one first positioning members includes two first positioning members which are extending transversely with fore-and-aft interval between each other, and the second positioning member includes a main body extending transversely and a plurality of locating ribs extending backwards and forwards respectively from the main body.

8. The cable connector according to claim 7, wherein at least one electrical component are mounted at the middle of the circuit board, a plurality of pads are disposed at both end of the circuit board respectively, the conductive terminals of the connector are soldered with the pads at one end of the circuit board correspondingly.

9. The cable connector according to claim 8, wherein the cable comprises a jacket and a plurality of core wires contained in the jacket, the core wires are soldered with the pads at the other end of the circuit board correspondingly.

10. The cable connector according to claim 1, wherein a plurality of locking hooks are extended toward the lower casing from the upper casing, and a plurality of locking parts are provided on the lower casing, for correspondingly connecting the locking hooks.

11. The cable connector according to claim 1, wherein at least one electrical component are mounted at the middle of the circuit board, a plurality of pads are disposed at both end of the circuit board respectively, the conductive terminals of the connector are soldered with the pads at one end of the circuit board correspondingly.

12. The cable connector according to claim 11, wherein the cable comprises a jacket and a plurality of core wires contained in the jacket, the core wires are soldered with the pads at the other end of the circuit board correspondingly.

13. The cable connector according to claim 2, wherein at least one electrical component are mounted at the middle of the circuit board, a plurality of pads are disposed at both end of the circuit board respectively, the conductive terminals of the connector are soldered with the pads at one end of the circuit board correspondingly.

14. The cable connector according to claim 13, wherein the cable comprises a jacket and a plurality of core wires contained in the jacket, the core wires are soldered with the pads at the other end of the circuit board correspondingly.

15. The cable connector according to claim 2, wherein a plurality of locking hooks are extended toward the lower casing from the upper casing, and a plurality of locking parts are provided on the lower casing, for correspondingly connecting the locking hooks.

16. The cable connector according to claim 3, wherein a plurality of locking hooks are extended toward the lower casing from the upper casing, and a plurality of locking parts are provided on the lower casing, for correspondingly connecting the locking hooks.

17. The cable connector according to claim 6, wherein at least one electrical component are mounted at the middle of the circuit board, a plurality of pads are disposed at both end of the circuit board respectively, the conductive terminals of the connector are soldered with the pads at one end of the circuit board correspondingly.

18. The cable connector according to claim 17, wherein the cable comprises a jacket and a plurality of core wires contained in the jacket, the core wires are soldered with the pads at the other end of the circuit board correspondingly.

19. The cable connector according to claim 6, wherein a plurality of locking hooks are extended toward the lower casing from the upper casing, and a plurality of locking parts are provided on the lower casing, for correspondingly connecting the locking hooks.

20. The cable connector according to claim 7, wherein a plurality of locking hooks are extended toward the lower casing from the upper casing, and a plurality of locking parts are provided on the lower casing, for correspondingly connecting the locking hooks.

* * * * *